US006540131B2

(12) United States Patent
Black

(10) Patent No.: US 6,540,131 B2
(45) Date of Patent: Apr. 1, 2003

(54) STATIONERY

(75) Inventor: Stephen Black, Nr Stourbridge (GB)

(73) Assignee: Mastermailer Stationery Limited, Birmingham (GB)

( * ) Notice: Subject to any disclaimer, the term of this patent is extended or adjusted under 35 U.S.C. 154(b) by 0 days.

(21) Appl. No.: 09/923,745

(22) Filed: Aug. 7, 2001

(65) Prior Publication Data

US 2002/0038817 A1 Apr. 4, 2002

Related U.S. Application Data

(60) Provisional application No. 60/223,136, filed on Aug. 7, 2000.

(51) Int. Cl.[7] ..... B65D 27/04
(52) U.S. Cl. ..... 229/92.3; 229/92.1; 229/929
(58) Field of Search ..... 229/92.1, 92.3, 229/929

(56) References Cited

U.S. PATENT DOCUMENTS

| | | | | | |
|---|---|---|---|---|---|
| 2,302,455 | A | * | 11/1942 | Mattson | 229/92.3 |
| 3,350,988 | A | * | 11/1967 | Schultz | 156/252 |
| 3,937,492 | A | * | 2/1976 | Biron | 229/303 |
| 4,050,582 | A | * | 9/1977 | Kalve | 229/315 |
| 4,738,391 | A | * | 4/1988 | Wiseman | 229/68.1 |
| 4,784,317 | A | | 11/1988 | Chen et al. | |
| 4,898,323 | A | * | 2/1990 | Chen et al. | 229/92.3 |
| 5,046,661 | A | | 9/1991 | Kimura | |
| 5,202,181 | A | * | 4/1993 | Hara et al. | 428/350 |
| 5,331,023 | A | * | 7/1994 | Columbus et al. | 523/161 |
| 5,941,451 | A | * | 8/1999 | Dexter | 229/69 |
| 6,136,119 | A | * | 10/2000 | Columbus et al. | 156/73.5 |

FOREIGN PATENT DOCUMENTS

| | | |
|---|---|---|
| EP | 0 543 540 | 5/1993 |
| WO | WO 00/07825 | 2/2000 |

* cited by examiner

*Primary Examiner*—Stephen P. Garbe
(74) *Attorney, Agent, or Firm*—Michael Best & Friedrich LLP

(57) ABSTRACT

A stationery form including a single sheet of printable material that has a self-seal contact adhesive applied to edge regions arranged to contact each other when the form is folded about a crease line. Contacting edge regions are releasably adhered when a first pressure is applied to seal temporarily the form in a folded condition such that the form can be opened and re-sealed. The contacting edge regions are non-releasably adhered when a second pressure higher than the first pressure is applied to seal permanently the form in the folded condition. Low pressure sealing may be achieved manually, for example by finger pressure. High pressure sealing may be provided with a pressure sealing machine. A permanently sealed form can be opened by tearing along lines of weakness inboard of the adhesive to remove the bonded regions.

17 Claims, 2 Drawing Sheets

STATIONERY

CROSS-REFERENCE TO RELATED APPLICATIONS

This application claims priority under 35 U.S.C. §119 to provisional patent application No. 60/223,136 filed on Aug. 7, 2000.

FIELD OF THE INVENTION

This invention concerns improvements in or relating to stationery. The invention has particular application to stationery forms comprising a single sheet of paper which may be printed and folded about one or more crease lines to conceal the printing and secure the form in a folded condition by means of adhesive whereby the form may be sent through the post without requiring the use of a separate envelope.

BACKGROUND OF THE INVENTION

Forms of this type are known in which the adhesive is applied as a continuous strip around the marginal edge of the form clear of the printable region of the form.

The adhesive may be water activated such as a gum which the user wets, e.g. by licking, and then presses to seal the form in the folded condition by finger pressure applied to the adhesive region of the folded form.

Alternatively, the adhesive may be self-sealing such as a contact adhesive which does not require wetting or any other activation prior to sealing. The contact adhesive may be a low pressure type which permanently seals the form in the folded condition when finger pressure is applied to the adhesive region of the folded form. This is suitable for manual sealing of the form where the number of forms to be sealed is small. Where the number of forms to be sealed is large such as for business use, it is usual to employ a sealing machine to automatically seal the forms in the folded condition.

Such machines can be designed to apply a much higher sealing force than is possible manually with a finger. As a result, a high-pressure type contact adhesive may be employed which permanently seals the form in the folded condition when sufficient pressure is applied but does not seal under finger pressure thereby reducing the risk of accidental or inadvertent sealing of the forms by finger pressure and/or of the forms sticking to each other.

A disadvantage of the known contact adhesives is that once the form is permanently sealed in the folded condition, either manually by finger pressure or automatically by machine pressure, the form can only be opened by removing the adhesively bonded regions from the rest of the form. This is usually effected by the provision of lines of weakness inboard of the adhesive so the adhesively bonded regions can be easily separated from the rest of the form. As a result, the form cannot be opened and re-sealed to make additions or alterations to the printed information after the form has been folded and sealed.

Yet another disadvantage is that when sealing the form in the folded condition, air can be trapped in the folded form and prevented from escaping by the continuous seal provided by the adhesive applied around the entire marginal edge of the form. This trapped air causes bulging of the folded and sealed form which, in turn, makes the form susceptible to tearing or other damage so as to make the printing applied to the form illegible and/or render the form unusable for its intended purpose. This is a particular problem if the form is intended to be completed with information by the recipient and returned to the sender.

SUMMARY OF THE INVENTION

Thus, it is an object of the present invention to provide a stationery form which can be sealed temporarily in a folded condition to allow the form to be opened and re-sealed if required and which can also be sealed permanently in the folded condition to prevent the form being opened until the adhesively bonded regions have been separated from the rest of the form.

It is yet another object of the present invention to provide a stationery form which can be folded and sealed temporarily or permanently in a folded condition without air being permanently trapped in the folded and sealed form until the form is opened and/or otherwise ruptured to release the air. Thus, according to a first aspect of the invention, there is provided a stationery form comprising a single sheet of paper or similar printable material to which a self-seal contact adhesive is applied so that adhesive regions contact and adhere releasably to each other when the form is folded and a first pressure applied to the contacting adhesive regions to seal temporarily the form in a folded condition, and which adhere non-releasably to each other when a second pressure higher than the first pressure is applied to the contacting adhesive regions to seal permanently the form in the folded condition.

By this invention, the contact adhesive provides a dual function to temporarily seal the form when a low pressure is applied, for example manually with a finger, that allows the form to be opened and re-sealed, and to permanently seal the form when a high pressure is applied, for example automatically with a sealing machine, that requires separation of the adhesively bonded regions to open the form.

In this way, the user can select whether to seal the form temporarily or permanently. Where the form is sealed temporarily, the form can be opened and re-sealed allowing additions or alterations to be made to the printed information by the sender and/or by the receiver without scrapping forms which have already been sealed. Thus, it is envisaged that the sender may seal the form temporarily to allow the recipient to open the form, add information and then seal permanently the form for return to the sender. In this way, unauthorised access to the information added by the recipient is prevented.

According to a second aspect of this invention, there is provided a stationery form comprising a single sheet of paper or similar printable material to which a self-seal contact adhesive is applied so that adhesive regions contact and adhere to each other when the form is folded to seal the form in a folded condition wherein the adhesive is applied as a discontinuous border strip leaving adhesive free regions which are aligned in the folded condition of the form to define one or more gaps between adhesively secured regions so as to allow air trapped in the folded and sealed form to escape.

By this invention, the form can be flattened after folding and sealing to expel trapped air through the gaps provided in the adhesively secured regions of the form. Thus, the simple expedient of providing the adhesive as a discontinuous strip avoids the problems of the prior art stationery forms while still enabling the form to be sealed in a folded condition suitable to be sent through the post. The adhesive may be chosen so that the form can be sealed either temporarily or permanently in accordance with the first aspect of the invention.

According to a third aspect of this invention, there is provided a stationery form comprising a single sheet of paper or similar printable material to which a self-seal contact adhesive is applied so that adhesive regions contact and adhere to each other when the form is folded to seal the form in a folded condition wherein the form is provided with a first window arranged to align with a first printable region of the form in the folded condition and a second window arranged to align with a second printable region of the form in the folded condition.

By this invention, the first and second printable regions can be printed with the addresses of the recipient and the sender at the same time the form is printed with the information to be sent to the recipient and both addresses are visible through the associated window in the folded condition of the form. As a result, the form can be printed in a single operation and, when sealed, a return address is provided which allows the form to be returned to the sender if the recipient has moved. The adhesive may be chosen so that the form can be sealed either temporarily or permanently in accordance with the first aspect of the invention, and/or the adhesive may be applied to prevent air being trapped in the folded condition of the form in accordance with the second aspect of the invention.

In a preferred embodiment according to each of the aspects of the invention, the form is designed to be folded in half when it is desired to close and seal the form in the folded condition. For this, the form is provided with a single crease or fold line across the centre between the side edges midway between the top and bottom of the form.

In this way, the edges of the top half are aligned with the edges of the bottom half and the contact adhesive is applied as a narrow border strip or band adjacent to the edges. As a result, the adhesive on the bottom half contacts and sticks to the adhesive on the top half when the form is folded about the crease line and pressure applied to the aligned adhesive regions.

It is desirable in each aspect of the invention that the forms can be stacked on top of each other in the unfolded condition without sticking to each other. In this way, a printer can be used to print the desired information on the forms which are supplied to the printer from a stack without risk of two or more forms becoming stuck together accidentally and jamming the printer feed.

The adhesive is preferably chosen so that an adhesive region will only stick to another adhesive region and, when the forms are stacked on top of each other in the unfolded condition, an adhesive region on one form does not contact an adhesive region on an adjacent form.

Where the form is designed to be folded in half, the adhesive is applied to the marginal edges on one side of the form only thereby allowing the forms to be stacked on top of each other without contact between the adhesive regions.

For forms which may be designed to be folded more than once, the adhesive may be applied to the marginal edges on both sides of the form and in this case, the adhesive regions on one side are preferably arranged to be offset from the adhesive regions on the other side so that the forms can be stacked without contact between the adhesive regions.

Preferably, the stationery form and the contact adhesive according to each of the aspects of the invention are selected to be compatible with most laser printers but it will be understood that the forms and adhesive may be chosen for use with other types of printers, e.g. inkjet or bubblejet printers.

Advantageously, the stationery form according to each aspect of the invention has a window arranged to align with a part of the form on which the name and address of a recipient of the form is placed so as to be visible through the window in the folded condition of the form. In this way, the details of the recipient can be printed on the form at the same time the form is printed with the information to be sent to the recipient in a single operation.

More preferably, however, the form is provided with two windows arranged to align with separate printable regions of the form in the folded condition whereby the addresses of both the recipient and the sender may be printed and visible through the associated window in the folded condition. In this way, the form can be returned to the sender either if the recipient has moved or if the form can be opened and re-sealed by the recipient to include information added to the form by the recipient.

The invention together with the benefits and advantages will be more fully understood from the description of exemplary embodiments later herein of the stationery form which I prefer to call "Master Mailer". It will be understood however that such description is not intended to be exhaustive of all possible applications and uses of the invention and that various modifications can be made without departing from the spirit and scope of the invention.

BRIEF DESCRIPTION OF THE DRAWINGS

Exemplary embodiments of the invention will now be described in more detail by way of example only with reference to the accompanying drawings wherein.

DETAILED DESCRIPTION OF THE INVENTION

Figure 1:
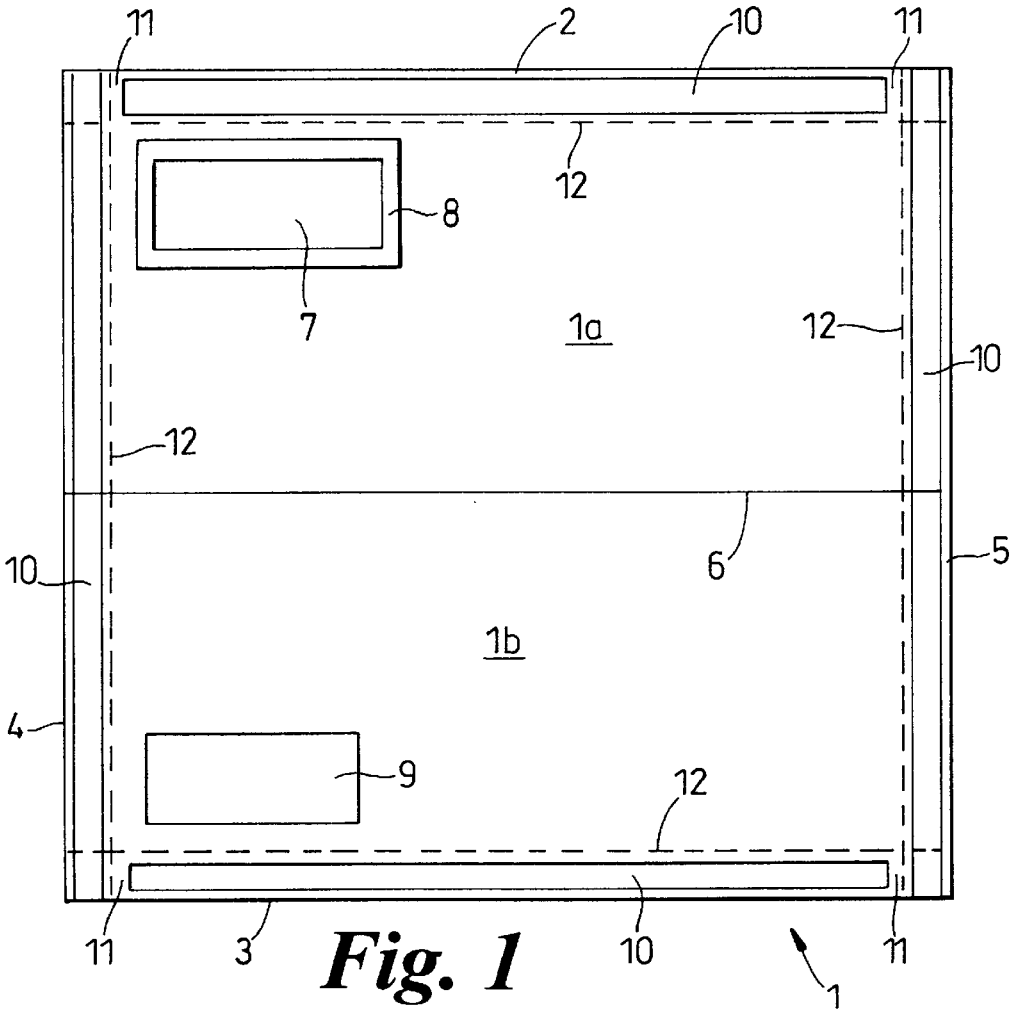
FIG. 1 is a plan view of a stationery form embodying the invention in a flat, unfolded condition.
Figure 2:
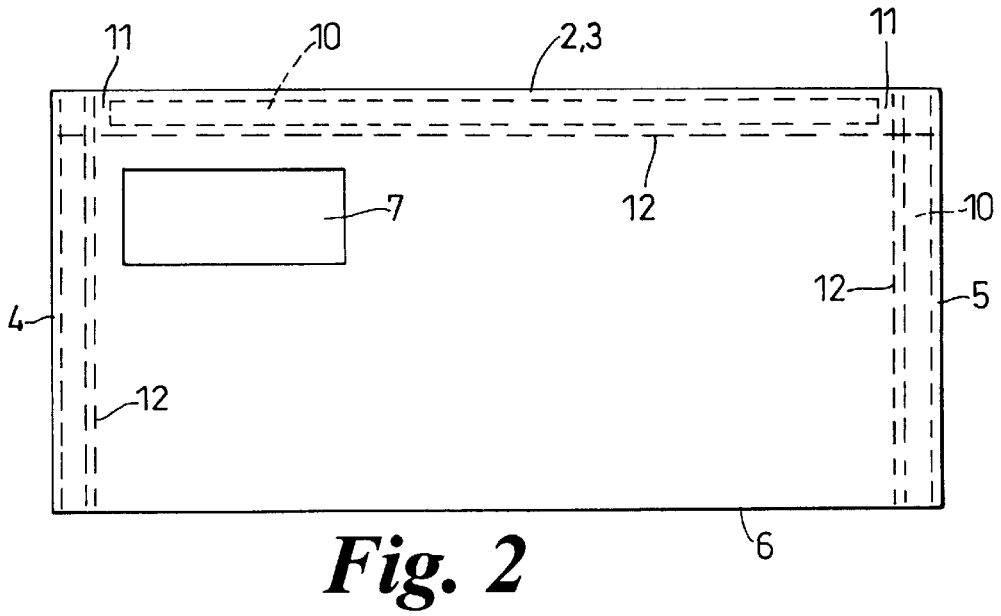
FIG. 2 is a plan view of the form shown in FIG. 1 in a folded and sealed condition.

Referring to FIGS. 1 and 2 of the drawings, a stationery form 1 which I call "Master Mailer" is shown comprising a single sheet of A4 size paper. Other sizes of paper may be employed and the following description embraces all sizes. The paper is compatible for laser printing and has a top edge 2, a bottom edge 3 and opposed side edges 4, 5.

A fold or crease line 6 is provided mid-way between the top and bottom edges 2, 3 to divide the form 1 into a top half 1*a* and a bottom half 1*b*. The crease line 6 facilitates folding the form 1 in half to superimpose the two halves 1*a*, 1*b* in a folded condition of the form shown in FIG. 2 when it is desired to close and seal the form 1 as described later. The crease line 6 may be formed by any suitable means and, in this embodiment, comprises a line of perforations in the paper.

The top half 1*a* is formed with a rectangular window 7 cut out of the paper in a comer region of the form 1. The window 7 is covered by a strip 8 of transparent or translucent material adhesively sealed around the marginal edge of the window 7 on the side of the form 1 which is innermost in the folded condition.

The window 7 is arranged to align with an opposed rectangular section 9 in a corner region on the bottom half 1*b* of the form in the folded condition. The section 9 is arranged to be printed with the name and address of the recipient of the form 1 so as to be seen through the window 7 in the folded condition of the form 1. In this way, this information can be printed at the same time as the form 1 is printed with the information to be sent to the recipient. As a result, the form 1 can be printed with all required information in a single operation and thereafter folded and sealed ready to send out in the post without requiring a separate operation to apply the name and address to the form 1.

As best shown in FIG. 1, adhesive 10 is provided on one side of the form 1 being the same side as that which is printed with the information to be sent to the recipient and which is innermost in the folded condition of the form 1. The adhesive 10 is applied as a narrow border strip inboard of the top and bottom edges 2, 3 and inboard of the side edges 4, 5.

The adhesive 10 is continuous along the length of the side edges 4, 5 and is discontinuous along the length of the top and bottom edges 2, 3 so that a narrow gap 11 is provided at each corner region between the side edges 4, 5 and the top and bottom edges 2, 3. The gaps 11 on the top half 1*a* are provided at the same position as the gaps 11 on the bottom half 1*b* so that, in the folded condition of the form 1 shown in FIG. 2, they are aligned and define openings through which air trapped inside the folded and sealed form 1 can escape.

As will be appreciated, the number and arrangement of the gaps 11 can be altered from that illustrated provided that, when the form 1 is folded, at least one opening is formed for trapped air to escape.

The adhesive 10 is chosen to seal temporarily the form 1 in the folded condition under a first pressure and to seal permanently under a second pressure higher than the first pressure. The first pressure typically equivalent to manual finger pressure for reversible sealing that allows the form 1 to be opened and re-sealed by the sender or by the recipient. The second pressure is significantly higher than finger pressure and typically requires use of a sealing machine for irreversible sealing that requires the bonded adhesive regions to be separated from the rest of the form 1 before the form 1 can be opened. Any suitable contact adhesive having the above properties may be employed. I use an aqueous contact adhesive having a pH of 10 and a viscosity of 13 poise at 20° C. based on a natural rubber latex stabilised with ammonia and containing synthetic polymer emulsion, antioxidants and anti-foam agents.

To facilitate opening by the recipient when the form 1 is permanently sealed, perforations 12 or other lines of weakness are provided inboard of the adhesive along the top and bottom edges 2, 3 and the side edges 4, 5. These perforations 12 are substantially aligned in the folded and sealed condition of the form 1 and allow the adhesively bonded edge regions to be removed by tearing along the perforations to open the form 1 and allow the information printed thereon to be read. This method of opening a permanently sealed form 1 provides a degree of security where the information printed on the form 1 is confidential as it will be readily apparent if the form 1 has been opened by tearing along the perforations 12. For applications where the information printed on the form 1 is non-confidential and the form 1 is sealed temporarily, the perforations 12 may not be required.

Figure 3:
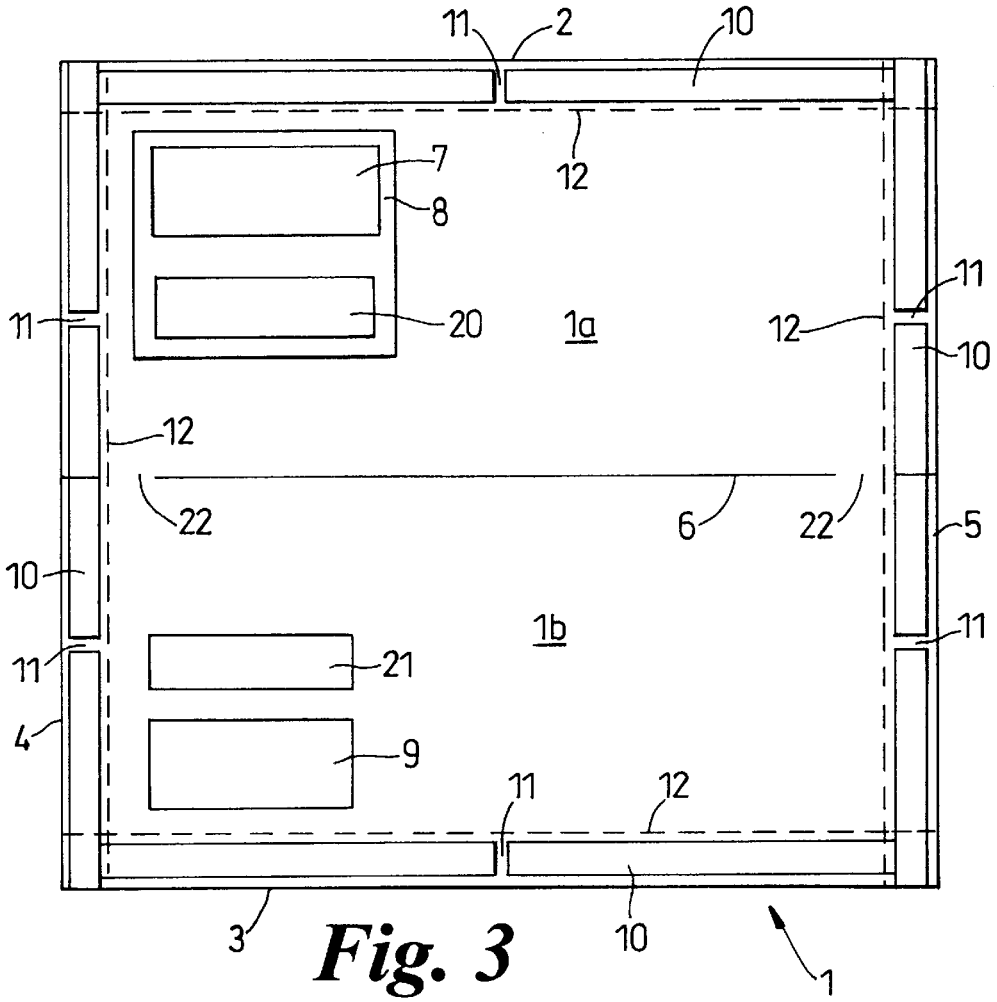
FIG. 3 is a plan view of an alternative stationery form embodying the invention, in a flat unfolded condition.
Figure 4:
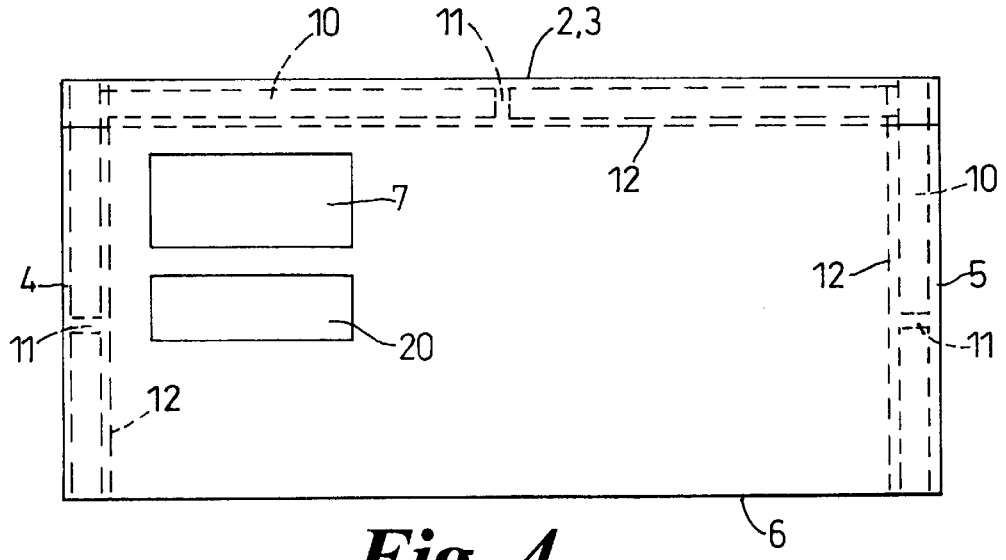
FIG. 4 is a plan view of the form shown in FIG. 3 in a folded and sealed condition.

Referring now to FIGS. 3 and 4, there is shown an alternative stationery form 1 which I also call "Master Mailer" in which like reference numerals are used to indicate parts corresponding to the previous embodiment.

In this embodiment, a second rectangular window 20 is provided below the window 7 in the upper half 1*a* of the form 1 to align with a second rectangular printable section 21 above the section 9 in the lower half 1*b* of the form in the folded condition of the form 1.

The strip 8 of transparent or translucent material covers both windows 7, 20 but it will be understood that the arrangement of the windows 7, 20 may be altered from that shown and/or that separate strips could be provided for each window 7, 20.

The second window 20 allows a return address to be printed and visible through the window 20 in the folded condition of the form 1. This return address can be printed at the same time as the rest of the form 1 is printed and allows the form 1 to be returned, for example if the recipient has moved.

As a further security feature in this embodiment, breaks 22 are provided in the perforations forming the crease line 6 inboard of the line of perforations 12 on each side edge 4, 5 of the form 1. These breaks 22 which may be from 5 to 10 mm in length provide stops (non-perforated regions) at each end of the crease line 6 remaining between the two halves 1*a*, 1*b* after tearing along the perforations 12 to remove the adhesively bonded edge regions to open the form 1.

In this way, after opening, accidental separation of the two halves 1*a*, 1*b* of the form 1 is prevented in a simple and effective manner. It will be understood, however, that the number and arrangement of breaks 22 may be altered from that shown although it is preferred to prevent initial propagation of a tear along the crease line 6 by providing the breaks 22 at the positions shown.

A different arrangement of the gaps 11 to form openings for air to escape when the form 1 is folded is also shown in this embodiment.

As will now be understood, the features of the stationary form 1 above-described provide many advantages and benefits. Thus, the dual sealing capability of the adhesive 10 enables the form 1 to be sealed temporarily or permanently at the choice of the user. The discontinuous sealing of the form 1 by the adhesive 10 prevents air being trapped in the form 1 during the folding operation which facilitates sealing and reduces the risk of damage to the form 1 in transit. The double window arrangement enables the form 1 to be printed with the address of the recipient and a return address. It will be appreciated that the invention is not limited to a stationery form having all of these features and that any one or more of these features may be provided in a stationery form.

While the invention has been described with reference to an individual form comprising a single sheet of paper, it will be understood that several forms may be attached via lines of weakness along top and bottom edges for supply to a printer with the individual forms being separated from each other after printing. In this application, the forms may be provided with additional tear-off strips along the side edges outboard of the adhesive regions and provided with a series of holes for engagement with a sprocket drive or similar feed mechanism to ensure the forms are supplied to the printer in the required orientation and position for printing.

It will also be appreciated that the forms may be used for a wide range of applications, for example to despatch advertising material, invoices, questionnaires etc to selected recipients. Other applications will be apparent to those skilled in the art and are within the scope of this invention.

I claim:

1. A stationery form comprising a sheet of printable material to which a self-seal contact adhesive is applied so that adhesive regions contact and adhere releasably to each other when said form is folded and a first pressure applied to contacting adhesive regions to seal temporarily said form in a folded condition, and which adhere non-releasably to each other when a second pressure higher than said first pressure is applied to said contacting adhesive regions to seal permanently said form in said folded condition, wherein said adhesive is applied as a discontinuous border strip leaving adhesive free regions which are aligned in said folded condition of said form to define at least one gap between adhesively secured regions so as to allow air trapped in the folded and sealed form to escape.

2. A stationery form according to claim 1 wherein said form is capable of being folded in half when it is desired to close and seal said form in said folded condition.

3. A stationery form according to claim 2 wherein said form is provided with a single crease line between opposed side edges and mid-way between top and bottom edges of said form.

4. A stationery form according to claim 1 wherein a plurality of forms can be stacked on top of each other in said unfolded condition without sticking to each other.

5. A stationery form according to claim 4 wherein said adhesive is chosen so that an adhesive region will only stick to another adhesive region and, when said forms are stacked on top of each other in the unfolded condition, an adhesive region on one form does not contact an adhesive region on an adjacent form.

6. A stationery form according to claim 1 wherein said sheet and contact adhesive are selected to be compatible with laser printers.

7. A stationery form according to claim 1 wherein said form is foldable along a line of weakness that is discontinuous to maintain integrity of said form when opened and unfolded.

8. A stationery form comprising a sheet of printable material to which a self-seal contact adhesive is applied so that adhesive regions contact and adhere releasably to each other when said form is folded and a first pressure applied to contacting adhesive regions to seal temporarily said form in a folded condition, and which adhere non-releasably to each other when a second pressure higher than said first pressure is applied to said contacting adhesive regions to seal permanently said form in said folded condition, wherein said form has at least one window arranged to align with a printable region of said form in said folded condition.

9. A stationery form according to claim 8 wherein said form has a first window arranged to align with a first printable region of said form in said folded condition and a second window arranged to align with a second printable region of said form in said folded condition.

10. A stationery form comprising a sheet of printable material to which a self-seal contact adhesive is applied so that adhesive regions contact and adhere releasably to each other when said form is folded and a first pressure applied to contacting adhesive regions to seal temporarily said form in a folded condition, and which adhere non-releasably to each other when a second pressure higher than said first pressure is applied to said contacting adhesive regions to seal permanently said form in said folded condition, wherein a plurality of forms can be stacked on top of each other in said unfolded condition without sticking to each other, wherein said adhesive is chosen so that an adhesive region will only stick to another adhesive region and, when said forms are stacked on top of each other in the unfolded condition, an adhesive region on one form does not contact an adhesive region on an adhesive form wherein said form is capable of being folded in half, and said adhesive is applied to marginal edges on one side of said form only thereby allowing a plurality of forms to be stacked on top of each other without contact between adhesive regions.

11. A stationery form comprising a sheet of printable material to which a self-seal contact adhesive is applied so that adhesive regions contact and adhere releasably to each other when said form is folded and a first pressure applied to contacting adhesive regions to seal temporarily said form in a folded condition, and which adhere non-releasably to each other when a second pressure higher than said first pressure is applied to said contacting adhesive regions to seal permanently said form in said folded condition, wherein a plurality of forms can be stacked on top of each other in said unfolded condition without sticking to each other, wherein said adhesive is chosen so that an adhesive region will only stick to another adhesive region and, when said forms are stacked on top of each other in the unfolded condition, an adhesive region on one form does not contact an adhesive region on an adhesive form, wherein said form capable of being folded more than once, and said adhesive is applied to marginal edges on both sides of said form with adhesive regions on one side arranged to be offset from adhesive regions on the other side so that a plurality of forms can be stacked without contact between adhesive regions.

12. A stationery form comprising a sheet of printable material to which a self-seal contact adhesive is applied so that adhesive regions contact and adhere releasably to each other when said form is folded and a first pressure applied to contacting adhesive regions to seal temporarily said form in a folded condition, and which adhere non-releasably to each other when a second pressure higher than said first pressure is applied to said contacting adhesive regions to seal permanently said form in said folded condition, wherein said sheet has a top edge, a bottom edge and opposed side edges, said adhesive is applied as a border strip inboard of said edges and lines of weakness are provided inboard of said adhesive.

13. A stationery form comprising a sheet of printable material to which a self-seal contact adhesive is applied so that adhesive regions contact and adhere to each other when said form is folded to seal said form in a folded condition wherein said adhesive is applied as a discontinuous border strip leaving adhesive free regions which are aligned in said folded condition of said form to define at least one gap between adhesively secured regions so as to allow air trapped in said folded and sealed form to escape, wherein said adhesive is chosen so that said form can be sealed temporarily by application of a first pressure and permanently by application of a second pressure higher than said first pressure.

14. A stationery form according to claim 13 wherein said adhesive is applied to one side only of said form to allow a plurality of said forms to be stacked on top of each other without adhering to each other, said form is provided with a single crease line between opposed side edges and mid-way between top and bottom edges of said form whereby said form can be folded in half when it is desired to close and seal said form in said folded condition, said form is further provided with lines of weakness inboard of said adhesive whereby adhesive secured regions can be removed when it is desired to open said form, and said crease line is discontinuous to maintain integrity of said form when opened and unfolded.

15. A stationery form comprising a sheet of printable material to which a self-seal contact adhesive is applied so that adhesive regions contact and adhere to each other when said form is folded to seal said form in a folded condition wherein said form is provided with a first window arranged to align with a first printable region of said form in the folded condition and a second window arranged to align with a second printable region of said form in said folded condition, wherein said adhesive is chosen so that said form can be sealed temporarily by application of a first pressure and permanently by application of a second pressure higher than said first pressure.

16. A stationery form according to claim 15 wherein said adhesive is applied as a discontinuous border strip leaving adhesive free regions which are aligned in said folded condition of said form to define at least one gap between adhesively secured regions so as to allow air trapped in said folded and sealed form to escape.

17. A stationery form according to claim 15 wherein said adhesive is applied to one side only of said form to allow a plurality of said forms to be stacked on top of each other without adhering to each other, said form is provided with a single crease line between opposed side edges and mid-way between top and bottom edges of said form whereby said form can be folded in half when it is desired to close and seal said form in said folded condition, said form is further provided with lines of weakness inboard of said adhesive whereby adhesive bonded regions can be removed when it is desired to open said form, and said crease line is discontinuous to maintain integrity of said form when opened and unfolded.

* * * * *